US005433430A

United States Patent [19]

Straessler et al.

[11] Patent Number: 5,433,430

[45] Date of Patent: Jul. 18, 1995

[54] DEVICE INCLUDING A FIRST AND AN ADJUSTABLE SECOND CONVEYING MEMBER FOR CONVEYING AND SEPARATING FOLDING PRINTER PRODUCTS

[75] Inventors: René Straessler, Jestetten, Germany; Beat Fritsche, Greifensee, Switzerland

[73] Assignee: Grapha-Holding AG, Hergiswil, Switzerland

[21] Appl. No.: 284,423

[22] PCT Filed: Nov. 16, 1993

[86] PCT No.: PCT/CH93/00260

§ 371 Date: Aug. 3, 1994

§ 102(e) Date: Aug. 3, 1994

[87] PCT Pub. No.: WO94/13567

PCT Pub. Date: Jun. 23, 1994

[30] Foreign Application Priority Data

Dec. 4, 1992 [CH] Switzerland ..... 03733/92

[51] Int. Cl.[6] ..... B65H 5/00

[52] U.S. Cl. ..... 271/225; 271/280; 271/286; 271/184

[58] Field of Search ..... 271/184, 185, 225, 198, 271/280, 285, 286, 300, 302, 303; 198/367, 457

[56] References Cited

U.S. PATENT DOCUMENTS

| | | | |
|---|---|---|---|
| 3,334,723 | 8/1967 | Reed et al. | 198/367 X |
| 4,319,675 | 3/1982 | Turnbough | 198/367 |
| 4,572,350 | 2/1986 | Besemann | 198/457 X |
| 4,986,730 | 1/1991 | Wetter | 198/457 X |
| 5,112,041 | 5/1992 | Honegger | 271/184 X |
| 5,323,892 | 6/1994 | Strassler et al. | 198/457 X |

FOREIGN PATENT DOCUMENTS

| | | |
|---|---|---|
| 0417622 | 3/1991 | European Pat. Off. . |
| 2417614 | 3/1977 | Germany . |
| 8400542 | 4/1988 | Germany . |
| 634530 | 2/1983 | Switzerland . |
| 677480 | 5/1991 | Switzerland . |

*Primary Examiner*—David H. Bollinger
*Attorney, Agent, or Firm*—Spencer, Frank & Schneider

[57] ABSTRACT

A first conveying member (11) has a gap (11) which is engaged by the front end of a second conveying member. This second conveying member conveys obliquely in respect to the first conveying member and has a lower and an upper draw-off belt (14). The front end of the upper draw-off belt (14) can be telescopically adjusted.

11 Claims, 2 Drawing Sheets

DEVICE INCLUDING A FIRST AND AN ADJUSTABLE SECOND CONVEYING MEMBER FOR CONVEYING AND SEPARATING FOLDING PRINTER PRODUCTS

BACKGROUND OF THE INVENTION

The invention relates to a device for conveying and separating folded printed products which are supplied on a conveyor device in a scale-shaped flow, wherein at least two printed products are laterally offset in respect to each other, wherein a conveying member is disposed on each side of the scale-shaped flow and wherein these conveying members move away from each other and pull the printed products apart.

A device of this species is known from CH-A-634 530. It has two parallel conveying members embodied as chains, which have clamping rollers for grasping the edges of the printed products. To pull the printed products, which are folded inside each other, apart, the chains are guided away from each other in rails. A similar device is known from DE-A-24 17 614. Here, movable grippers are provided for grasping and pulling apart the printed products folded inside each other. Both devices are respectively set for a defined width of the scale-shaped flow. Conversion to another width would be very expensive.

SUMMARY OF THE INVENTION

It is the object of the invention to provide a device of the species mentioned, by means of which it is possible to convey scale-shaped flows of varied width. Conversion is intended to be possible very simply and rapidly. In addition, the device is also intended to be suitable for separating scale-shaped flows with more than two printed products which are folded inside each other or lie on top of each other. This object is attained in the device in accordance with the species in that a first conveying member has a gap, which is engaged by the front end of the other, second conveying member, which conveys obliquely in respect to the first conveying member and has a lower pull-off belt and an upper pull-off belt, and that the front end of the upper pull-off band can be telescopically adjusted in the conveying direction of the second conveying member.

With the device in accordance with the invention it is only necessary to adjust the front end of the upper draw-off belt to adapt it to the width of the scale-shaped flow to be separated. Depending on the width of the scale-shaped flow, the front end of the upper draw-off belt enters the gap of the first conveying member more or less deeply. The printed products are not bent when they are drawn out and therefore are more gently treated than was customary up to now. In addition, the device is considerably more cost-effective and has a small space requirement. The protruding edges of the printed products to be pulled out of the scale-shaped flow are grasped by the two draw-off belts and are conveyed between the two draw-off belts obliquely in respect to the first conveying member to a further conveying member. The printed products are grasped flat between the two draw-off belts and are securely guided throughout the entire pull-off process. By means of this it is also possible to separate scale-shaped flows wherein the printed products have very unusual formats. In addition, it is assured that electrostatic adhesion between the printed products does not result in a malfunction. It has been shown that with the device in accordance with the invention the offset can be considerably less than the offset of the printed products which are folded inside each other or disposed on top of each other which was customary up to now. The separation of a scale-shaped flow consisting of two or more partial scale-shaped flows disposed on top of each other and laterally offset is also possible. It is possible by means of this to increase the conveying capacity in a cost-effective manner. Further advantageous characteristics ensue from the dependent claims, the subsequent description and the drawings.

BRIEF DESCRIPTION OF THE DRAWINGS

An exemplary embodiment of the invention will be described in detail by means of the drawings. Shown are in.

DETAILED DESCRIPTION OF THE INVENTION

Figure 1:
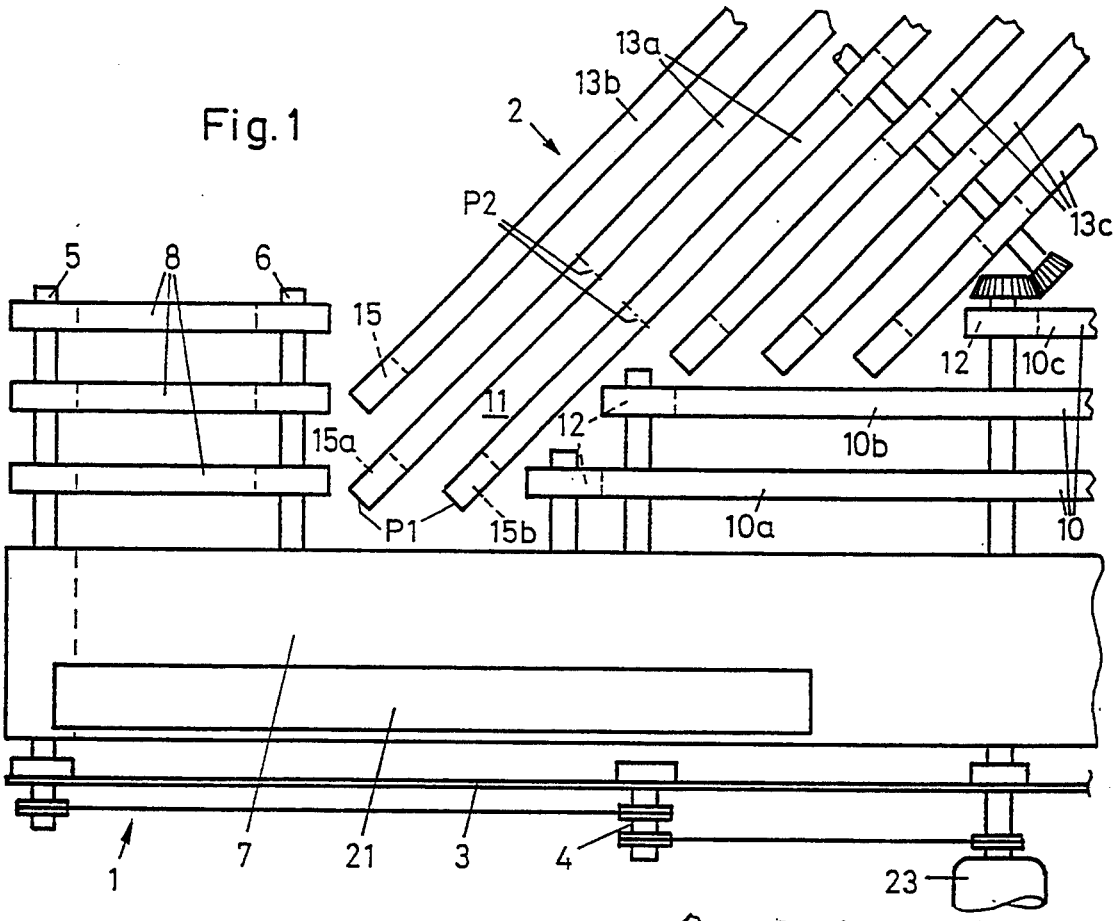
FIG. 1, a partial view of the device in accordance with the invention.
Figure 2:
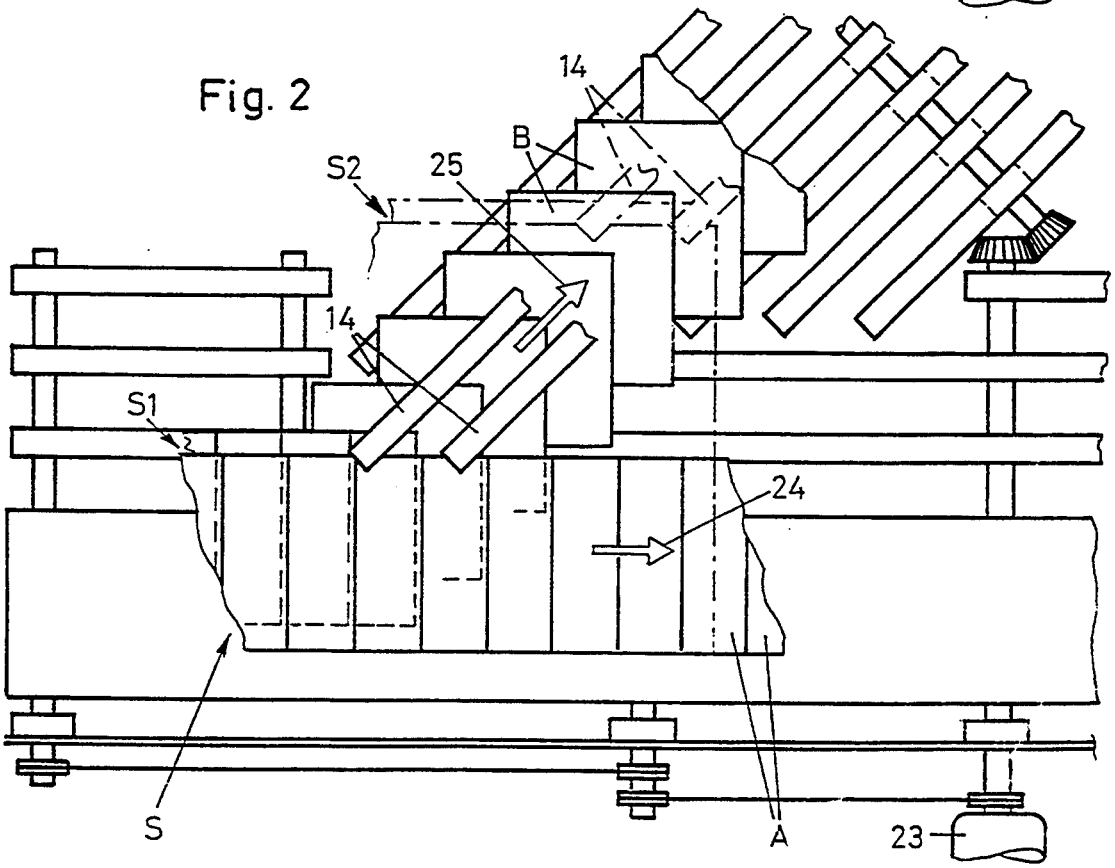
FIG. 2, a partial view of the device in accordance with the invention with a scale-shaped flow placed on it, FIG. 3, a schematic partial view of the second conveying member, FIG. 4, a schematic partial view of the first conveying member, and FIG. 5, a schematic view of the separation of a scale-shaped flow by means of the device in accordance with the invention.

FIGS. 1 and 2 show a first conveying member 1 extending straight and a second conveying member 2, also extending straight. These conveying members 1 and 2 are driven via shafts 4 and 5 by means of a motor 23.

Figure 4:
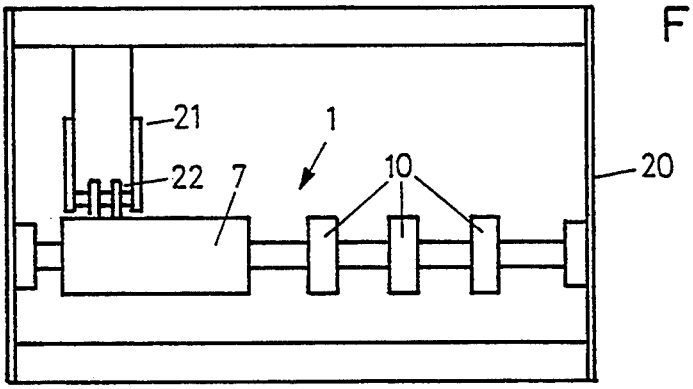

The conveying member 1 has a comparatively wide pressure belt 7 and partial belts 8 and 10. The partial belts 8 and the belt 7 are driven by a common shaft 5. The other end of the belt 7, not shown here, is placed around a shaft, not shown here. The belts 8 are considerably shorter than the belt 7 and are placed around a shaft 6 extending parallel to the shaft 5. There is a gap 11 between the belts 8 and 10, which is engaged by the second conveying member 2. The belts 10 are placed around rollers 12 which are disposed offset in the conveying direction, as can be seen, in such a way that the gap becomes wider with increasing distance from the belt 7. The front end of the second conveying member 2 is embodied to be correspondingly stepped. As mentioned, the belts 7, 8 and 10 are commonly driven and the upper sides extend in the same horizontal plane and in the same direction, indicated by the arrow 24. A pressure bar 21 is disposed above the belt 7, which cooperates with the belt 7 in order to grasp the edge of a scale-shaped flow S. In accordance with FIG. 4, the pressure bar 21 also has rotating belts 22, the lower side of which is being moved in the same direction and at the same speed as the upper side of the belt 7. Pressure bars of this type are known.

Figure 3:
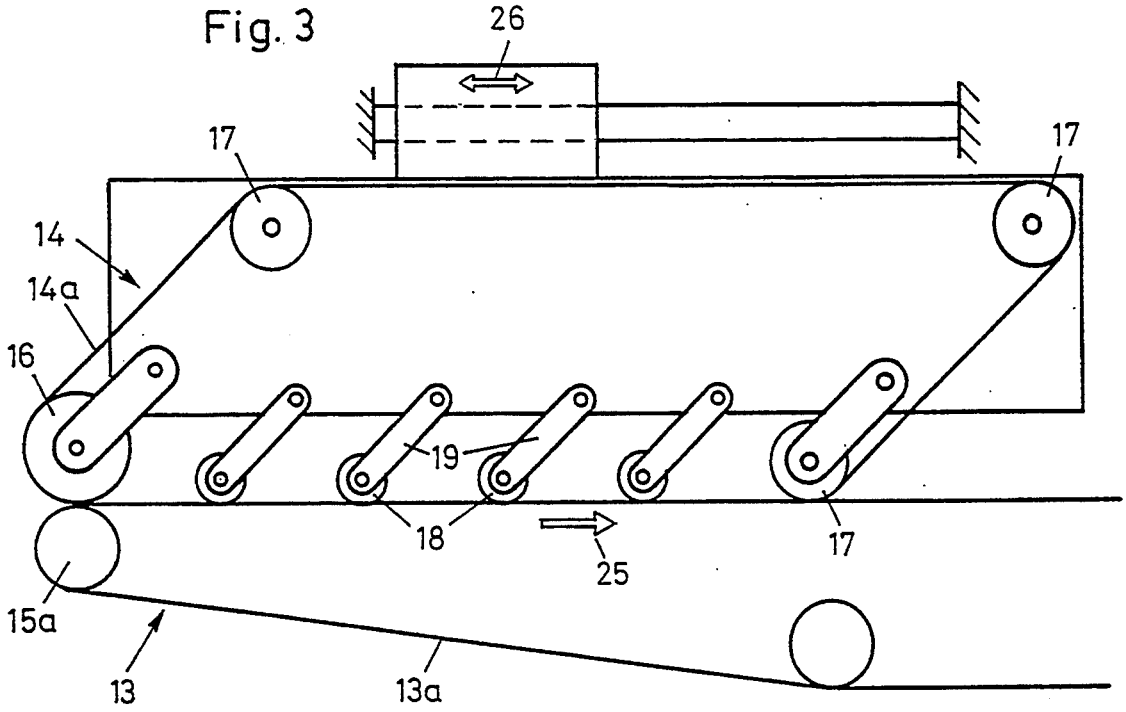

The second conveying member 2 has a lower draw-off belt 13 and an upper draw-off belt 14, which extend obliquely and preferably at an angle of approximately 45° in respect to the first conveying member 1. The conveying direction of the conveying element 2 is indicated by the arrow 25. The conveying speed of the conveying member 1 has been selected to be such that the speed component in the direction of conveying of the conveying member 1 is as great as the conveying speed of the conveying member 1. The lower draw-off belt 13 consists of six partial belts 13*a*–13*c* disposed parallel to each other, which turn around a roller 15 at the respective front ends. As can be seen in FIG. 1, these rollers 15 are arranged offset in the conveying direction in correspondence with the gap 11. Two belts 13*a*, disposed parallel next to each other, respectively cooperate with an upper belt 14*a* for grasping and pulling out printed products B from the scale-shaped flow S. The belts 14*a* are respectively guided around a front reversing roller 16 and reversing rollers 17, as shown in FIG. 3. Rollers 18, which are respectively seated on spring-loaded levers 19, provide the uniform pressure of the lower side of the belt 14 against the corresponding belt 13. The remaining belts 13*b* and 13*c* are merely used as supports for the printed products B, as shown in FIG. 2. As a rule, the upper sides (surface) of the belts 13 extend horizontally and preferably a little below the plane of the upper side (surface) of the belts 7, 8 and 10. The belts 14*a* are telescoping belts in that the roller 16 can be displaced in the directions of the two-headed arrow 26. Such telescoping belts are well known per se. Adjustment can be performed rapidly and precisely by means of a handwheel, not shown here. The operational characteristics of the device will be briefly described below, in particular by means of FIGS. 2 and 5.

The scale-shaped flow S illustrated in FIG. 2 consists of printed products A and B, which are folded inside each other, such as newspapers or magazines of the usual kind. The printed products A and B are laterally offset in respect to each other, so that in FIG. 2 the lower edge is formed by the printed products A and the upper edge by the printed products B alone. The scale-shaped flow S which, in FIG. 2 is transferred from the left side to the conveying member 1, is conveyed in the direction of the arrow 24. In the process the edges of the printed products A are kept between the pressure bars 21 and the belt 7. Because of this the printed products are moved in the direction of the arrow 24 without a transverse movement. However, the printed products B are grasped in the gap 11 by the draw-off belts 13 and 14 and pulled out of the scale-shaped flow S obliquely in respect to the arrow 24. So that the printed products B are only grasped at their respectively projecting edge, the two rollers of the belts 14*a* are positioned to correspond with the gap 11. The two end positions of the rollers 16 are indicated by P1 and P2 in FIG. 1. At the position P1 a comparatively narrow scale-shaped flow S1 is separated and a considerably wider scale-shaped flow S2 at the position P2. The rollers 16 can be continuously displaced between the two positions P1 and P2. Following separation from the scale-shaped flow S, the printed products A and B respectively form a scale-shaped flow again, which can be transferred to further conveying members not shown here. The two partial belts 13*a* can also be replaced by a single belt, however, it has been shown that when using two belts the printed products B are considerably better stabilized. This is of particular importance when it is intended to convey printed products with unusual formats.

Figure 5:
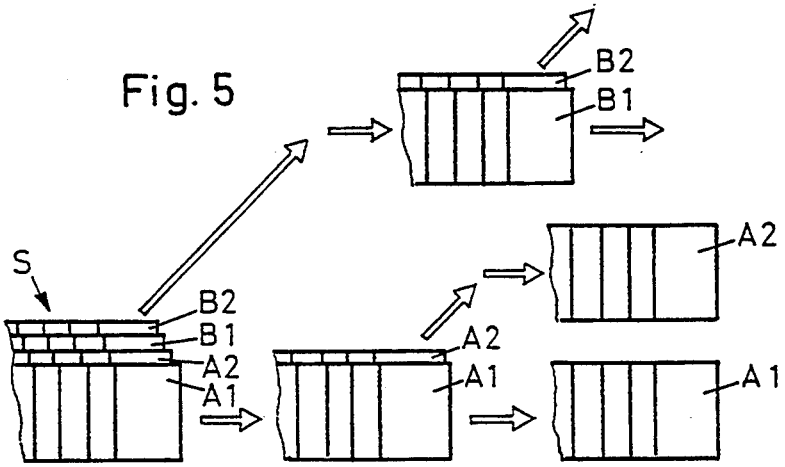

The device in accordance with the invention is also suitable in connection with a scale-shaped flow S which, in accordance with FIG. 5, consists of four printed products A1, A2, B1 and B2, which are folded inside each other. This scale-shaped flow S can be separated in any possible manner by an appropriate adjustment of the upper draw-off belt 14. For example, the printed products B2 can be separated from the remaining printed products A1, A2 and B1. It is also possible to separate the printed products B1 and B2 from the printed products A1 and A2 in a first step, as shown in FIG. 5. Two scale-shaped flows of the printed products A1 and A2 and B1 and B2, respectively, are created by this separation. These scale-shaped flows can then be further separated by means of further devices in accordance with the invention, so that a total of four scale-shaped flows are created, which consist of only one printed product A1, A2, B1 or B2.

The edges of the printed products can be disposed in front or in back and respectively at the top or the bottom The scale-shaped flow can also consist of two or more partial scale-shaped flows disposed on top of each other but laterally offset. These partial scale-shaped flows can be separated by means of the device as described above. In this way it is possible to convey several partial scale-shaped flows disposed on top of each other on one conveying section ahead of the separating point.

We claim:

1. A device for conveying and separating at least two folded printed products laterally offset relative to each other and supplied to the device on a conveyor in a scale-shaped flow, comprising:

a first conveying member for moving one of the two folded printed products in a first direction, said first conveying member defining a gap formed therein; and a second conveying member for moving the other one of the two folded printed products in a second direction oblique to the first direction, said second conveying member having a lower draw-off belt having a front end located in the gap of said first conveying member, and an upper draw-off belt having a front end telescopically adjustable in the second direction to engage with the other one of the two folded printed products.

2. A device for conveying and separating folded printed products as defined in claim 1, wherein said first conveying member includes a pressure bar extending in the first direction, and a plurality of partial belts extending parallel to each other and laterally to the pressure bar.

3. A device for conveying and separating folded printed products as defined in claim 2, wherein the plurality of partial belts extend longitudinally in the first direction to respectively define the gap.

4. A device for conveying and separating folded printed products as defined in claim 3, wherein the gap increases in a direction away from the pressure bar with each partial belt.

5. A device for conveying and separating folded printed products as defined in claim 1, wherein said lower draw-off belt and said upper draw-off belt each includes at least two partial belts extending parallel to each other, said at least two lower draw-off belts cooperating with said at least two upper draw-off belts.

6. A device for conveying and separating folded printed products as defined in claim 1, wherein said first conveying member and said second conveying member each moves the respective folded printed product at essentially the same speed.

7. A device for conveying and separating folded printed products as defined in claim 1, wherein said lower draw-off belt comprises at least two adjacent partial belts extending parallel to each other for drawing off the other one of the two folded printed products from the scaled-shaped flow, and a plurality of additional partial belts arranged adjacent to the at least two adjacent partial belts for supporting the other one of the two folded printed products from the scaled-shaped flow.

8. A device for conveying and separating folded printed products as defined in claim 1, wherein a surface of said second conveying member is located below a surface of said first conveying member.

9. A device for conveying and separating folded printed products as defined in claim 1, wherein said second conveying member extends at an acute angle relative to said first conveying member.

10. A device for conveying and separating folded printed products as defined in claim 9, wherein the acute angle is about 45 degrees.

11. A device for conveying and separating folded printed products as defined in claim 1 wherein the first conveying member conveys the one folded printed product in a straight line both before and after the gap.

* * * * *